US008007307B2

(12) United States Patent
Wang

(10) Patent No.: US 8,007,307 B2
(45) Date of Patent: Aug. 30, 2011

(54) CONNECTOR WITH FASTENING AND EXTENSION PLATES FOR FASTENING COVER THEREOF TO BODY THEREOF

(75) Inventor: Chu-Li Wang, Taipei (TW)

(73) Assignee: Emcom Technology Inc., Taipei (TW)

( * ) Notice: Subject to any disclaimer, the term of this patent is extended or adjusted under 35 U.S.C. 154(b) by 0 days.

(21) Appl. No.: 12/960,462

(22) Filed: Dec. 3, 2010

(65) Prior Publication Data

US 2011/0136371 A1 Jun. 9, 2011

(30) Foreign Application Priority Data

Dec. 4, 2009 (TW) ..... 98141615 A

(51) Int. Cl.
*H01R 13/62* (2006.01)

(52) U.S. Cl. ..... 439/367

(58) Field of Classification Search ..... 439/367, 439/314, 135, 352, 373, 31
See application file for complete search history.

(56) References Cited

U.S. PATENT DOCUMENTS 3,986,765 A * 10/1976 Shaffer et al. ..... 439/314
4,621,884 A * 11/1986 Berkebile et al. ..... 439/367
5,338,211 A * 8/1994 Kodama et al. ..... 439/135
7,559,788 B2 * 7/2009 Legg ..... 439/373
7,731,519 B1 * 6/2010 Swenson, Jr. ..... 439/352

FOREIGN PATENT DOCUMENTS

TW M277130 10/2005

* cited by examiner

*Primary Examiner* — Chandrika Prasad
(74) *Attorney, Agent, or Firm* — Cheng-Ju Chiang

(57) ABSTRACT

A connector is provided. The connector includes a connector body, a signal transmitting unit, a cover, a fastening plate, and an extension plate. The connector body has side walls to enclose an assembly hole. The signal transmitting unit is disposed in the assembly hole. The cover has a first end, a second end, and a first pivot and is disposed outside the assembly hole. The first end and the first pivot are disposed on two ends of a side case of the cover. The second end is opposite to the first end while the first pivot is axially connected to one side of the assembly hole. The fastening plate has a second pivot opposite and parallel to the first pivot. The second pivot axially connected to the side wall around the assembly hole. One end of the extension plate has a third pivot parallel to the first pivot and is rotatably connected to the fastening plate. The other end of the extension plate has a pressing portion to press the second end of the cover from outside to make the cover rotates toward the connector body and press the signal transmitting unit.

11 Claims, 13 Drawing Sheets

CONNECTOR WITH FASTENING AND EXTENSION PLATES FOR FASTENING COVER THEREOF TO BODY THEREOF

CROSS REFERENCE TO RELATED APPLICATIONS

This application claims priority based on a Taiwanese Patent Application No. 098141615, filed on Dec. 4, 2009, the disclosure of which is incorporated herein by reference in its entirety.

BACKGROUND OF THE INVENTION

1. Field of the Invention

The present invention relates to a connector; particularly, the present invention relates to a connector capable of fastening the wire-carrying cover without using an auxiliary tool.

2. Description of the Related Art

Generally speaking, twisted-pair (TP) cables are the most prevalent network cable used in a local area network (LAN). The twisted-pair cable is composed of four pairs of different color wires (totally eight wires). Twisted-pair cables have the advantages of low cost, high connection reliability, easy maintenance, and high speed, such as 1000 Mbps or more. Twisted-pair cables can be applicable not only for data transmission but also for signal transmission such as voice signal or other multimedia signal transmission. Hence, twisted-pair cables have become one of the most favorite cables for network cabling. There are generally two types of twisted-pair cables including shielded twisted-pair (STP) cables and unshielded twisted-pair (UTP) cables, wherein the shielded twisted-pair cable is better in shielding electromagnetic radiations but much more expensive.

In constructing a network, the network performance will be affected by the connection quality of twisted-pair cables. As shown in FIG. 1, the Taiwanese Patent No. M277130 discloses a clip 40 for assembling a plurality of cables 20 inserted in the trough 13 of the wire-carrying cover 10 with a body 30 having a plurality of terminal 31. When employing the clip 40 to press the wire-carrying cover 10 and the body 30 together, the terminal 31 can pierce through the outer insulating material of the cable 20 so as to electrically connect with the conductor (generally a copper wire) of the cable 20 and achieve the goal of assembly.

However, for constructing an enterprise LAN, a plenty of time and labor cost are necessary when employing the clip 40 to assemble the wire-carrying cover 10 with the body 30. Consequently, the inventor proposes an inventive connector to overcome the above-mentioned problem and achieve other objectives.

SUMMARY OF THE INVENTION

It is an objective of the present invention to provide a clamp type connector for saving assembly time and labor cost and an operating method thereof.

It is another objective of the present invention to provide a clamp type connector which is easy to use and better in engagement and an operating method thereof.

It is another objective of the present invention to provide a clamp type connector which can be employed without using any auxiliary tool and an operating method thereof.

The connector of the present invention includes a connector body, a signal transmitting unit, a cover, a fastening plate, and an extension plate. The connector body has side walls to enclose an assembly hole. The signal transmitting unit is disposed in the assembly hole. The cover having a first end, a second end, and a first pivot is disposed outside the assembly hole. The first end and the first pivot are disposed on two ends of a side case of the cover. The second end is opposite to the first end and the first pivot is axially connected to one side of the assembly hole. The fastening plate has a second pivot corresponding to and parallel to the first pivot. The second pivot is axially connected to the side wall around the assembly hole opposite to the first pivot. One end of the extension plate has a third pivot parallel to the first pivot and rotatably connected to the fastening plate. The other end of the extension plate has a pressing portion to press the second end of the cover from outside to make the cover rotate toward the connector body and drives the cover to press the signal transmitting unit.

In one embodiment of the present invention, the connector body has a pair of positioning holes while the cover includes a pair of pillars assembled with the pair of positioning holes to form the first pivot. The second end of the cover is formed with a pair of recesses. The pressing portion of the extension plate includes a pair of pillars; the pair of pillars of the extension plate protrude from two sides of the extension plate to be engaged with the pair of the recesses. A pair of pillars extends from two sides of the fastening plate while the connector body has a pair of cavities for assembling with the pair of pillars of the fastening plate to form the second pivot. The fastening plate further has a positioning groove, and the extension plate has an opening and a bar close to the opening, wherein the fastening plate passes through the opening to allow the bar to be positioned in the positioning groove so as to form the third pivot.

In addition, the signal transmitting unit includes a connecting base and a wire-carrying cover. The cover presses the wire-carrying cover to move toward the connecting base. The side wall of the connector body includes a resilient portion disposed corresponding to the position of the fastening plate when engaged. When the fastening plate presses the resilient portion, the fastening plate moves toward the connector body to generate a displacement. The cover includes a plurality of side cases and a top plate, the side cases together with the top plate form a recess. A pressing board of the extending plate extends away from the pressing portion. The pressing board passes through the recess and presses a top end of the signal transmitting unit when the pressing portion presses the cover.

The present invention further provides a method for operating the connector including the following steps: step 1 rotating the cover around the first pivot to press one end of the signal transmitting unit; step 2 rotating the fastening plate around the second pivot away from the connector body to an initial engaging position; step 3 rotating the extension plate around the third pivot to press the second end of the cover with the pressing portion; step 4 rotating the fastening plate from the initial engaging position toward the connector body to an engaging position, such that the cover moves toward the connector body to press the signal transmitting unit inwardly.

In addition, in step 1, the step of pressing the signal transmitting unit further includes assembling a connecting base with the assembly hole of the connector body, and electrically coupling a wire-carrying cover with the connecting base. In step 4, the method further includes pressing the top end of the wire-carrying cover by a pressing board extending from the pressing portion to enhance the engagement of the wire-carrying cover and the connecting base. In a preferred embodiment, the method further includes adjusting a distance between the fastening plate and the second pivot and a distance between the third pivot of the extension plate and the pressing portion to change an angle of the initial engaging position and a pressing force. The angle that the fastening plate moves from the initial engaging position to the engaging position is between 0 degree and 155 degrees.

DETAILED DESCRIPTION OF THE PREFERRED EMBODIMENT

The present invention provides a connector which can save assembling time and labor cost and an operating method thereof. In a preferred embodiment, the connector is a network connector such as RJ45, and can be optionally formed as a metal shielding connector which can prevent electromagnetic interference (EMI). However, in other embodiments, the connector can be applied to universal serial bus (USB) connector or other types of connectors. The connector can be made of plastics or other materials such as electrically conductive or magnetically conductive materials. The detailed structure and operation steps will be described below with reference to figures.

Figure 1:
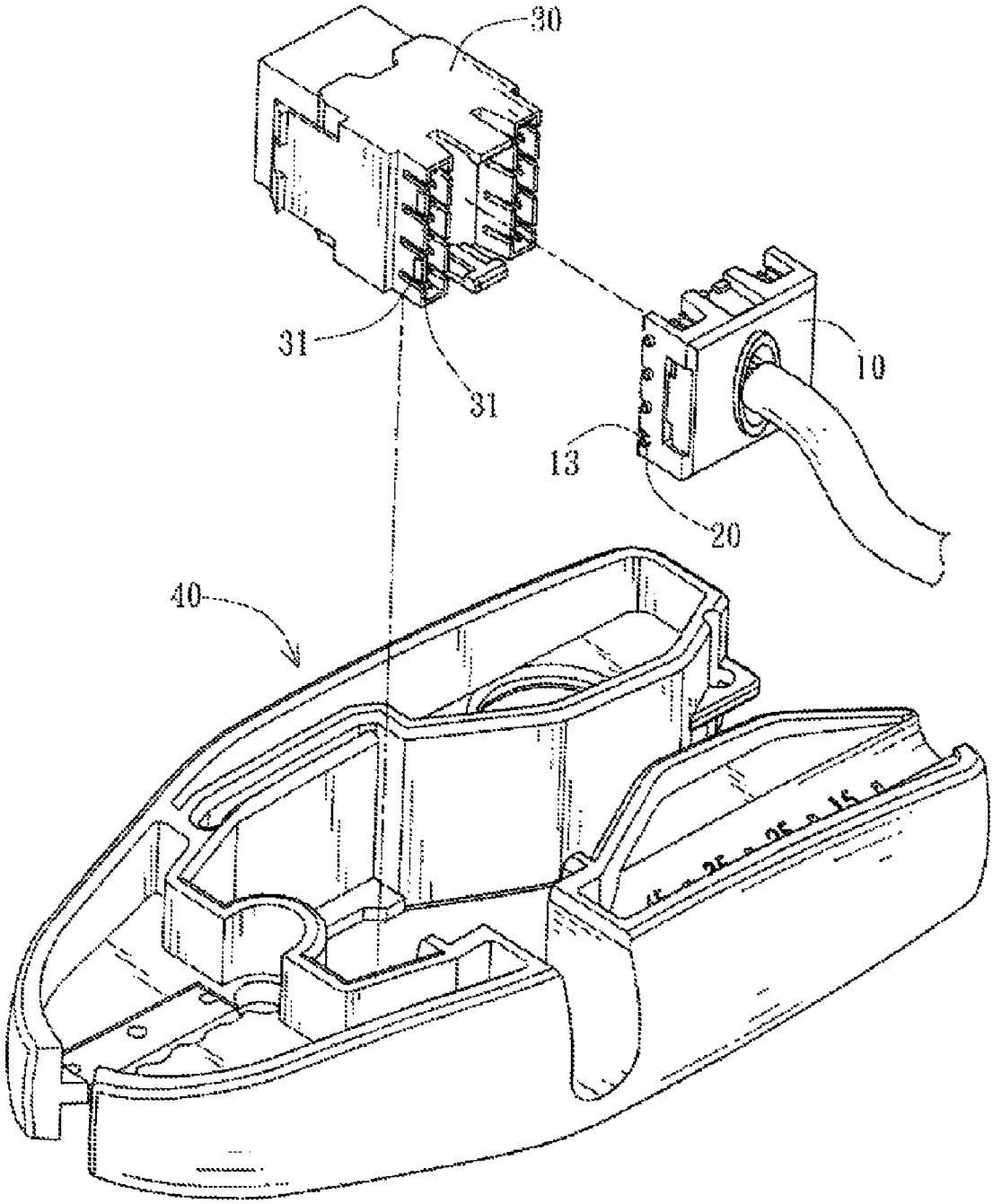
FIG. 1 (Prior Art)
FIG. 1 is a schematic view of a conventional connector.
Figure 2:
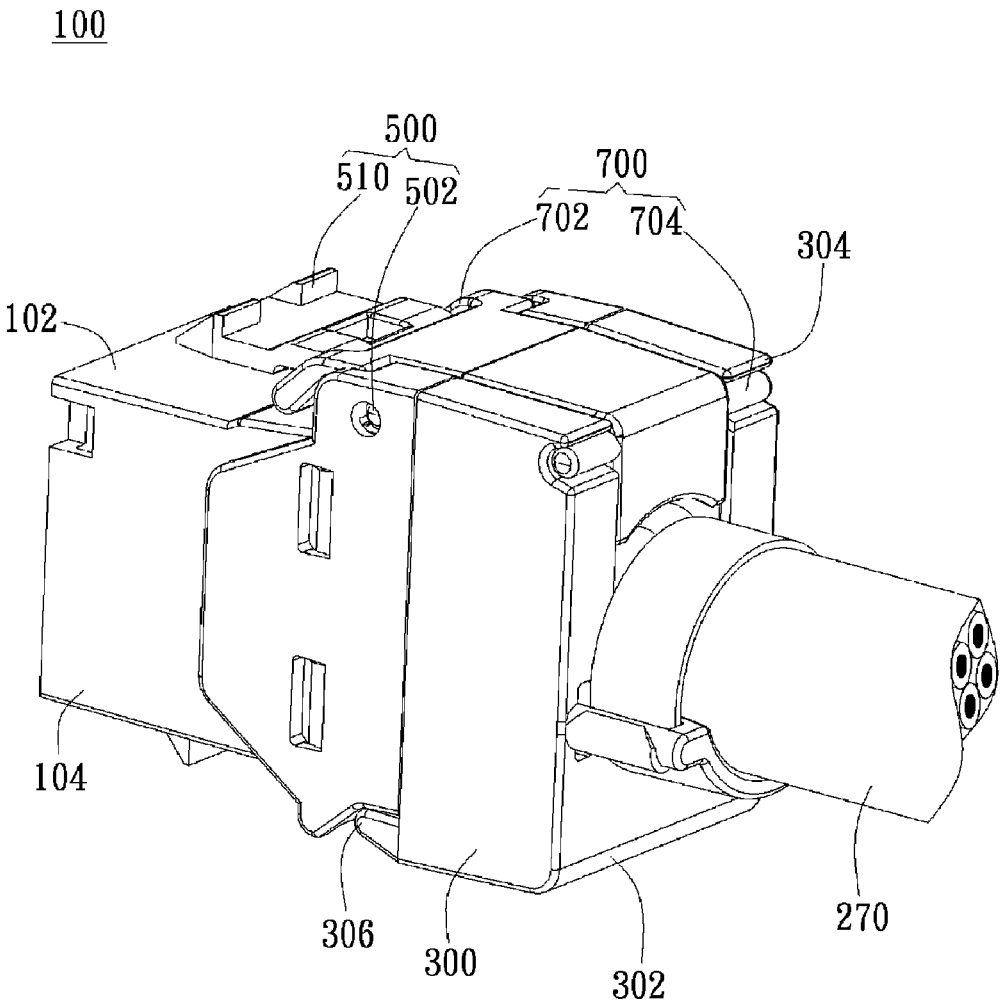
FIG. 2 is a three dimensional view of the connector of the present invention.
Figure 3:
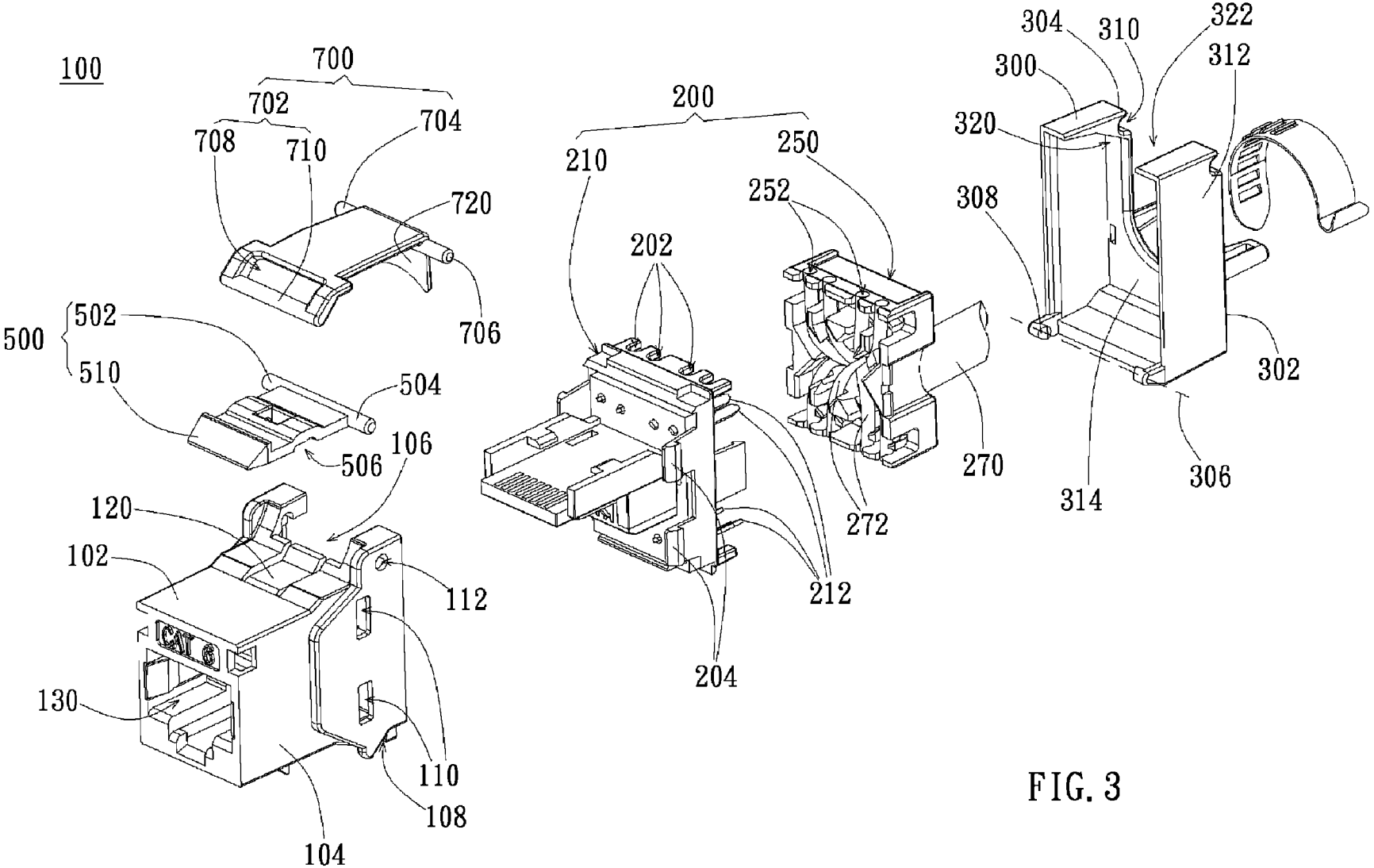
FIG. 3 is an exploded view of the connector of the present invention.

As shown in FIG. 2 and FIG. 3, the present invention provides a connector 100 including a connector body 102, a signal transmitting unit 200, a cover 300, a fastening plate 500, and an extension plate 700. The connector body 102 has several side walls 104 to enclose an assembly hole 106 on one side. Opposite to the assembly hole 106, a slot 130 is provided on the other side of the connector body 102 for a plug (not shown) to be inserted therein. The signal transmitting unit 200 including a connecting base 210 and a wire-carrying cover 250 is disposed in the assembly hole 106. As shown in the embodiment of FIG. 3, the wire-carrying cover 250 is assembled with the connecting base 210 in a manner that the connecting base 210 is firstly inserted into the connector body 102 via the assembly hole 106, and then the wire-carrying cover 250 with a transmission cable 270 connected thereto is connected to the connecting base 210. Please note that the connecting base 210 has a plurality of positioning hooks 204 on its sides and the positioning hooks 204 are engaged with the positioning slots 110 on the sidewall 104 of the connector body 102 so that the connecting base 210 is connected to the connector body 102. The transmission cable 270 is preferably an unshielded twisted-pair cable. However, in other embodiments, the transmission cable 270 can be a shielded twisted-pair cable or other type of cables such as network cables or telephone lines.

Figure 4:
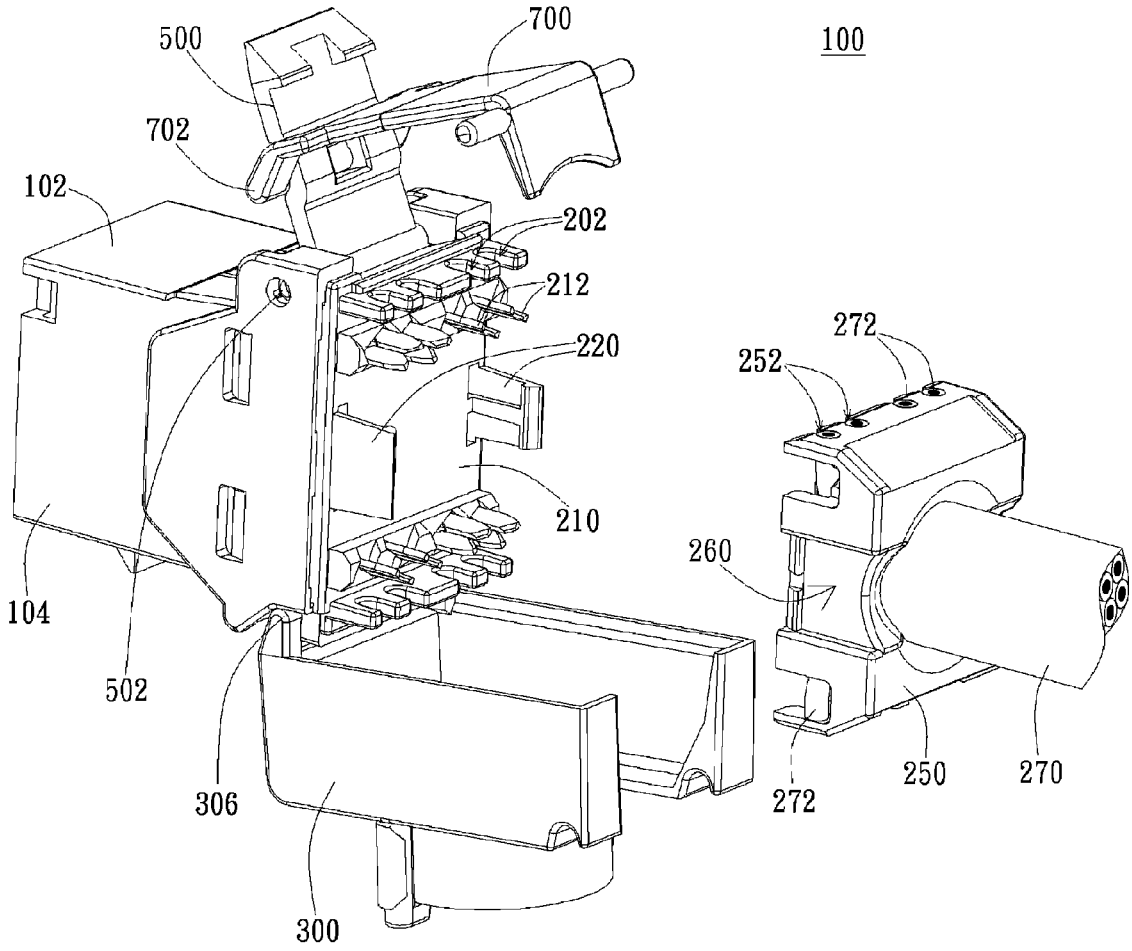
FIG. 4 is a schematic view of an embodiment of assembling the wire-carrying cover with the connector body.
Figure 5:
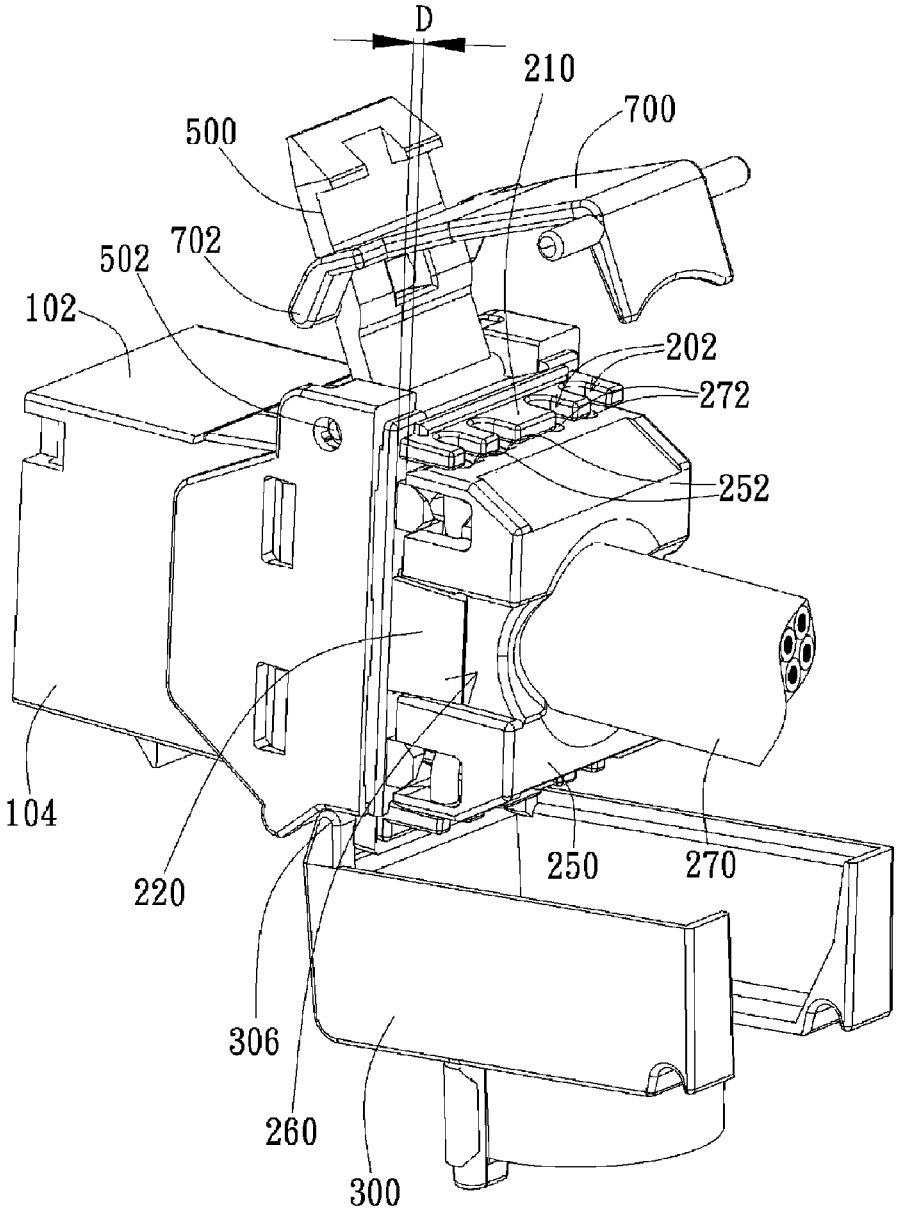
FIG. 5 is a schematic view of an embodiment of assembling the wire-carrying cover with connecting base.

Please refer to FIG. 4 and FIG. 5. To assemble the wire-carrying cover 250 with the connecting base 210, the transmission cable 270 has a plurality of core wires 272 inserted into corresponding clipping grooves 252 of the wire-carrying cover 250, and then engaged with the puncturing terminals 212 on the connecting base 210. When the wire-carrying cover 250 is assembled with the connecting base 210, the puncturing terminals 212 will pierce through the insulation film of each core wire 272 to electrically connect with the copper wire of the corresponding core wire 272. In this embodiment, for example, when the connecting base 210 and the wire-carrying cover 250 are appropriately assembled, 8 puncturing terminals 212 will pierce through the insulation films of 8 core wires 272, and each puncturing terminal 212 will electrically connect the conductor (such as copper wire) of a respective core wire 272. As shown in the embodiment of FIG. 5, since each core wire 272 has a certain width, a gap D exists between the wire-carrying cover 250 and the connecting base 210 when initially assembled. The size of gap D depends on the size of the transmission cable 270 or the distance between elements of the wire-carrying cover 250 and the connecting base 210. Moreover, the size of each core wire 272 will also affect the size of gap D. Furthermore, by means of the cover 300, the fastening plate 500, the extension plate 700, etc, each core wire 272 disposed in the wire-carrying cover 250 can be further engaged with the engaging groove 202 of the connecting base 210 to allow the puncturing terminal 212 to pierce through the insulation film of the core wire 272. The details will be elaborated hereinafter.

Please refer to FIG. 3 and FIG. 6 to FIG. 8. The cover 300 having a first end 302, a second end 304, and a first pivot 306 is disposed outside the assembly hole 106. As shown in FIG. 3, the cover 300 further includes a plurality of side cases 312 and a top plate 314 to form a housing in a shape similar to a rectangle. That is, the top plate 314 is connected to three side cases 312 to enclose a recess 320 which is an open space facing and at least partially accommodating the wire-carrying cover 250. An opening 322 is formed on the top plate 314. The opening 322 communicates with the recess 320 formed by the top plate 314 and the side cases 312. In this embodiment, the recess 320 is formed by connecting the side cases 312 and the top plate 314 at one side of the cover 300 to allow the transmission cable 270 to pass therethrough via the opening 322. The first end 302 and the first pivot 306 are located on two opposite ends of the side case 312. The second end 304 is opposite to the first end 302. The first pivot 306 is axially connected to the sidewall 104 around the assembly hole 106. The first end 302 and the second end 304 are respectively disposed on two ends of the top plate 314 opposite to the first pivot 306, wherein the second end 304 is disposed farther from the first pivot 306 than the first end 302. The sidewall 104 of the connector body 102 has a pair of positioning holes 108, and the first pivot 306 of the cover 300 includes a pair of pillars 308, wherein the pillars 308 are engaged with the positioning holes 108 to form the first pivot 306.

A pair of pillars 504 extend from one end of the fastening plate 500 on opposite sides, and the sidewall 104 of the connector body 102 has a pair of cavities 112 corresponding to the pillars 504. The pillars 504 are engaged with the cavities 112 to form a second pivot 502. The second pivot 502 is parallel to the first pivot 306 and adjacent to the assembly hole 106. However, in other embodiments, the design of the holes 108 and the cavities 112 of the connecting body 102 and the pillars 308 and the pillars 504 can be interchanged as desired to form appropriate first and second pivots.

One end of the extension plate 700 has a third pivot 702 parallel to the first pivot 306 and rotatably connected to the fastening plate 500. The other end of the extension plate 700 has a pressing portion 704 capable of rotating from outside toward the connector body 102 and pressing the second end 304 of the cover 300 to drive the cover 300 to press the signal transmitting unit 200, so that the wire-carrying cover 250 can be completely engaged with the connecting base 210. The pressing portion 704 is preferably a pair of pillars 706 protruding from two sides of the extension plate 700 as a rod. However, in other embodiments, the pressing portion 704 can be formed as a stick, a shaft or a bar disposed on one end of the extension plate 700 and forms the pillars 706 protruding from two sides of the extension plate 700. As shown in the embodiment of FIG. 3, the fastening plate 500 further has a positioning groove 506 and an engaging portion 510, wherein the engaging portion 510 for engaging with a wiring panel (not shown) is disposed opposite to the pillar 504. The positioning groove 506 is disposed between the engaging portion 510 and the pillar 504, preferably approximately at the middle. The extension plate 700 has an opening 708 formed on the end opposite to the pillars 706 and a bar 710 adjacent to the opening 708. When the engaging portion 510 of the fastening plate 500 is inserted through the opening 708 of the extension plate 700, the bar 710 engages with the positioning groove 506 to form the third pivot 702. The third pivot 702 is a dynamic rotatable pivot which rotates in response to the movement of the fastening plate 500.

In addition, please refer to FIG. 3 and FIG. 6 to FIG. 9, recesses 310 are formed on the second end 304 of the cover 300 and located on two opposite sides with respect to the recess 320. The pressing portion 704 of the extension plate 700 includes a pair of pillars 706 protruding from two sides of the extension plate 700 to respectively correspond to the recesses 310 and engage with the pair of the recesses 310. The extension plate 700 further has a pressing board 720 extending away from the pressing portion 704. The pressing board 720 is preferably parallel to the surface of the wire-carrying cover 250 or the top plate 314 when engaged. In other words, in this embodiment, when the pressing portion 704 of the extension plate 700 presses the cover 300, the pressing board 720 passes through the recess 320 to press the signal transmitting unit 200 by pressing the cover 300. The connector body 102 further has a resilient portion 120 disposed corresponding to the position of the fastening plate 500 when engaged. For example, the resilient portion 120 includes a splint cut from the side wall 104. When the fastening plate 500 presses the resilient portion 120, the fastening plate 500 can move inwardly toward the sidewall 104 of the connector body 102 to increase the moveable range/angle of the fastening plate 500 so as to enhance the operability and the buffering function. In other words, when the fastening plate 500 is engaged with the connector body 102, the fastening plate 500 presses the resilient portion 120 inwardly, and the resilient portion 120 pushes back the fastening plate 500 to engage with the connector body 102 after the fastening plate 500 is in contact with the sidewall 104.

Figure 6:
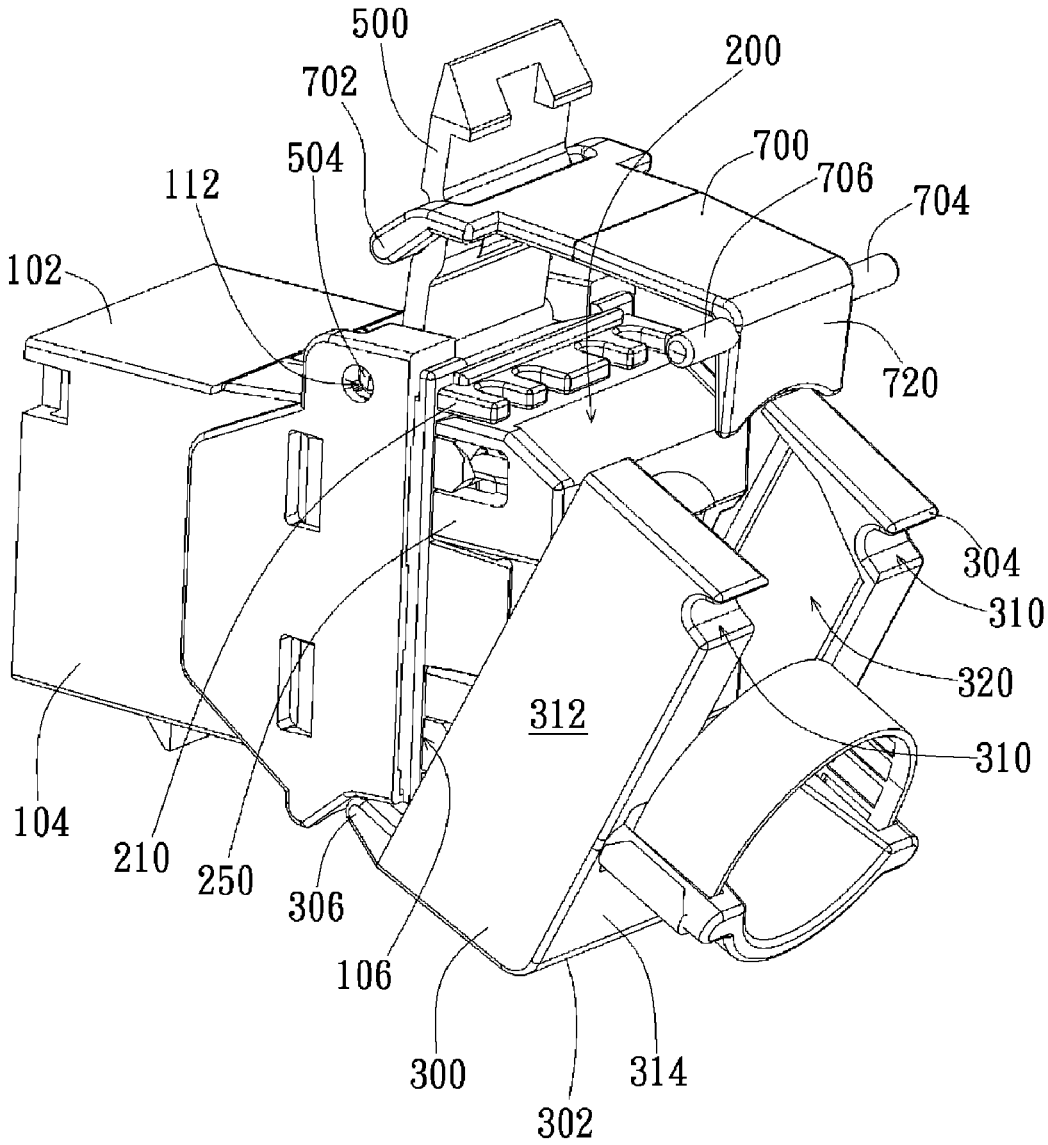
FIG. 6 is a schematic view of an embodiment of the cover pressing the wire-carrying cover.
Figure 7:
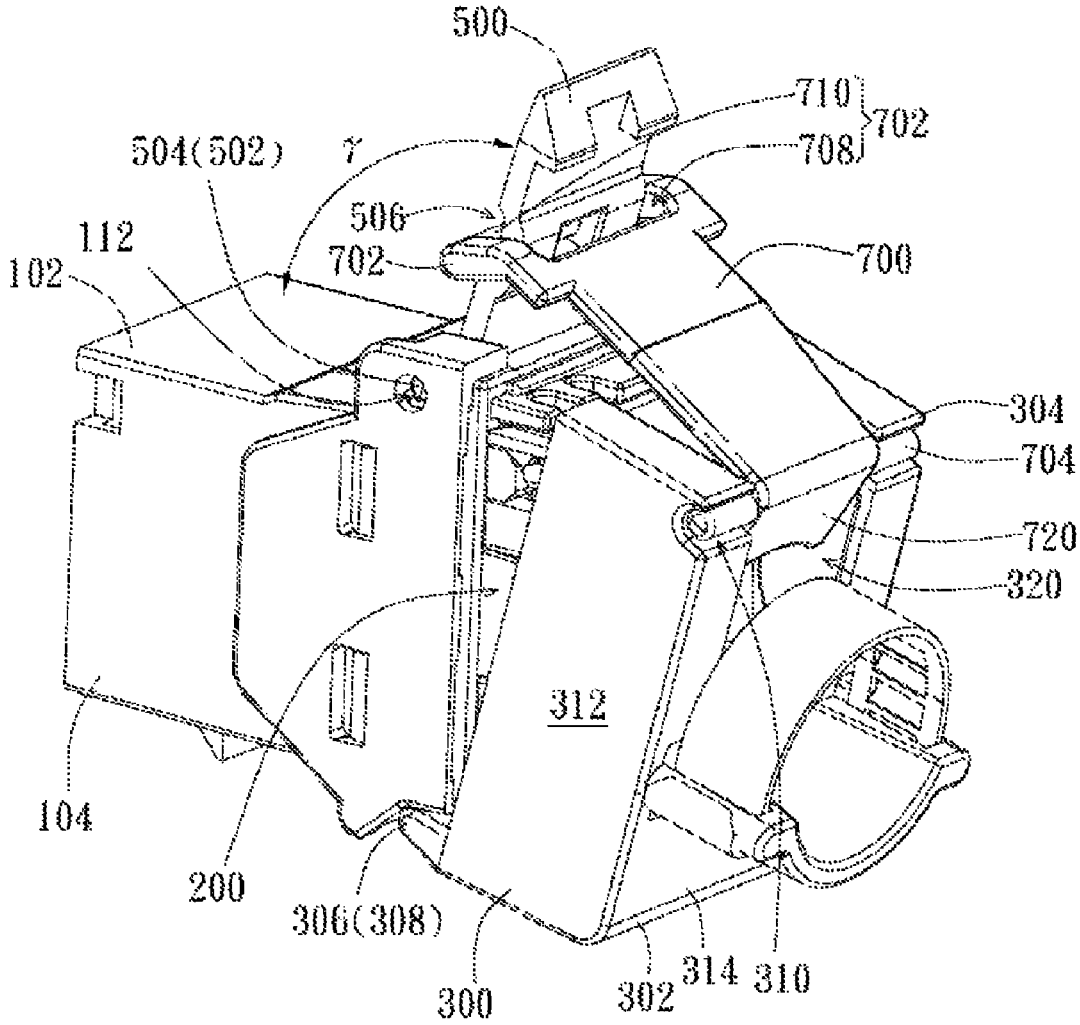
FIG. 7 is a schematic view of an embodiment of the extension plate pressing the second end of the cover.
Figure 8:
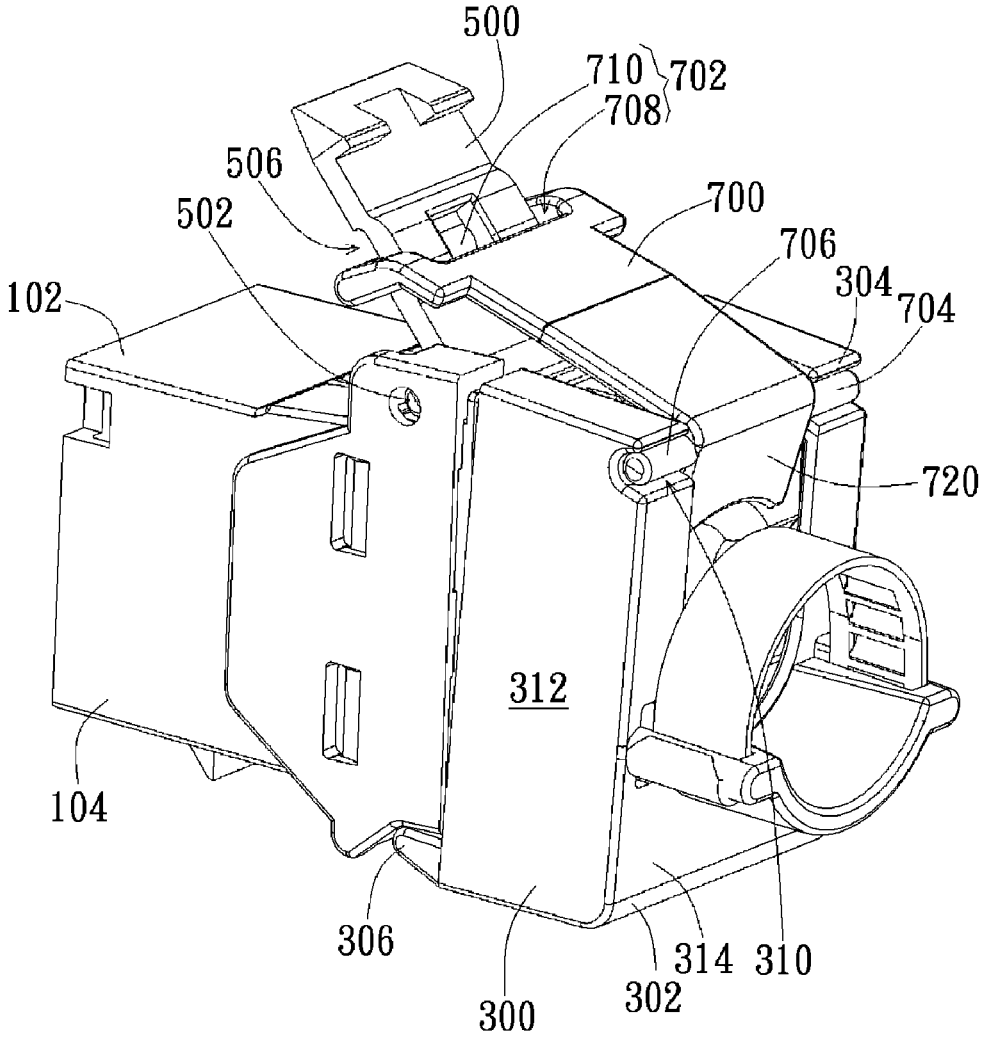
FIG. 8 is a schematic view of an embodiment of the fastening plate driving the extension plate to press the wire-carrying cover.

In the embodiment of FIG. 6 to FIG. 8, when the fastening plate 500 moves toward the second end 304 of the cover 300, as shown in FIG. 6, the extension plate 700 moves along with the fastening plate 500. When the pillar 706 of the extension plate 700 is engaged with the recesses 310 of the cover on the second end 304, as shown in FIG. 7, the fastening plate 500 is located at an initial fastening position and an engaging angle γ exists between the fastening plate 500 and the connector body 102. The engaging angle γ shown in FIG. 7 is preferably between 0 degree and 155 degrees and can be changed according to the size of transmission cable. In a preferred embodiment, the engaging angle γ is between 0 degree and 90 degrees. In the embodiment shown in FIG. 8, the engaging angle γ is preferably between 0 degree and 60 degrees, i.e. the optimal angle for the user to apply force.

Figure 9:
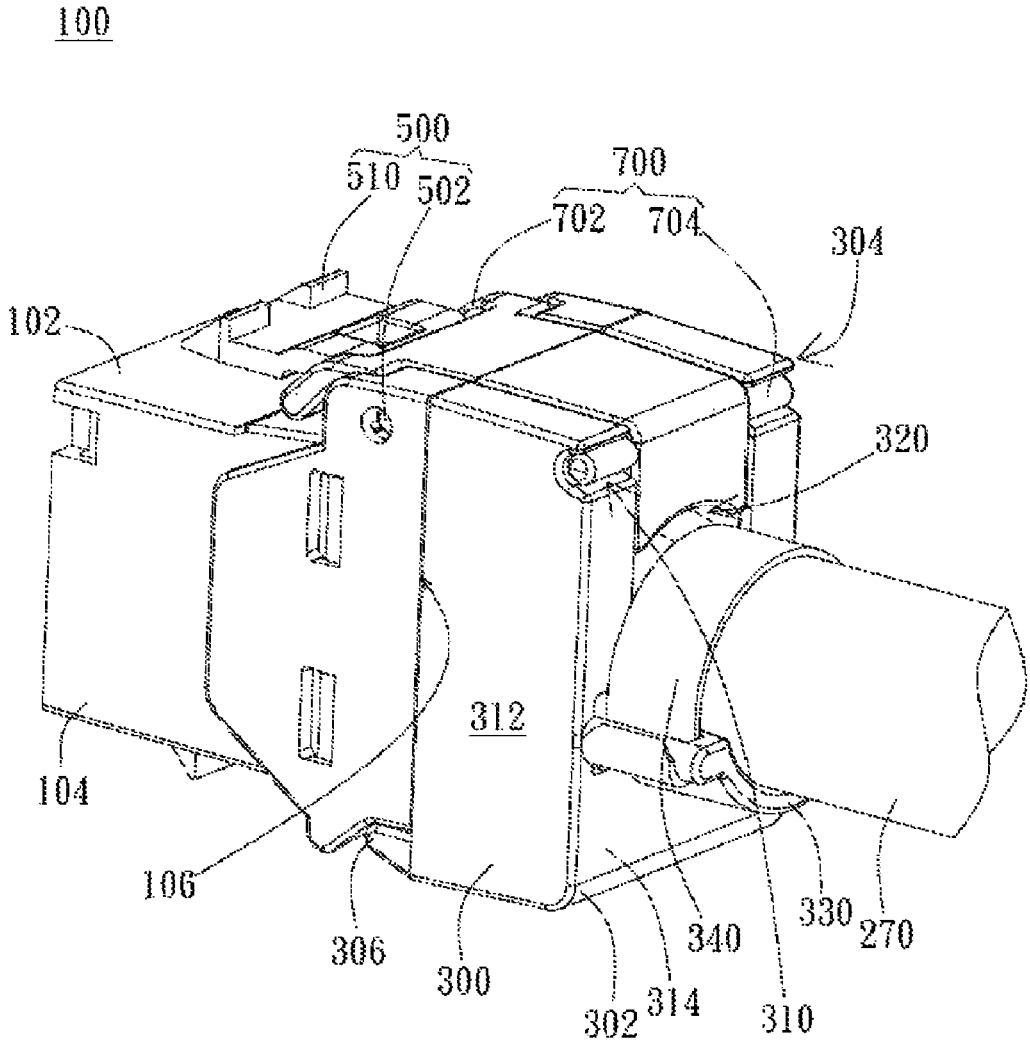
FIG. 9 is a schematic view of the wire-carrying cover positioned in place.

As shown in FIG. 9, when the fastening plate 500 moves to an engaging position (i.e. final engaging position), the third pivot 702 of the extension plate 700 will be moved to a position near the sidewall 104 of the connector body 102, and the side case 312 of the cover 300 will completely cover the assembly hole 106 to finish the engaging operation. That is, in response to the movement of the fastening plate 500 from the initial engaging position to the final engaging position, the extension plate 700 moves to allow the pressing portion 704 to engage with the recesses 310 and push the cover 300 to move toward the connector body 102. As such, the wire-carrying cover 250 is pushed by the cover 300 and appropriately assembled with the connecting base 210 so that the puncturing terminals 212 can pierce through the insulation film of the core wires 272 and connect the conductors of the core wires 272. In the embodiment as shown in FIG. 9, the top plate 314 of the cover 300 further has a positioning ring base 330 and a movable ring 340 which can be assembled with the positioning ring base 330. The transmission cable 270 protruding out of the recess 320 of the cover 300 is positioned by the positioning ring base 330 and the movable ring 340.

Figure 10:
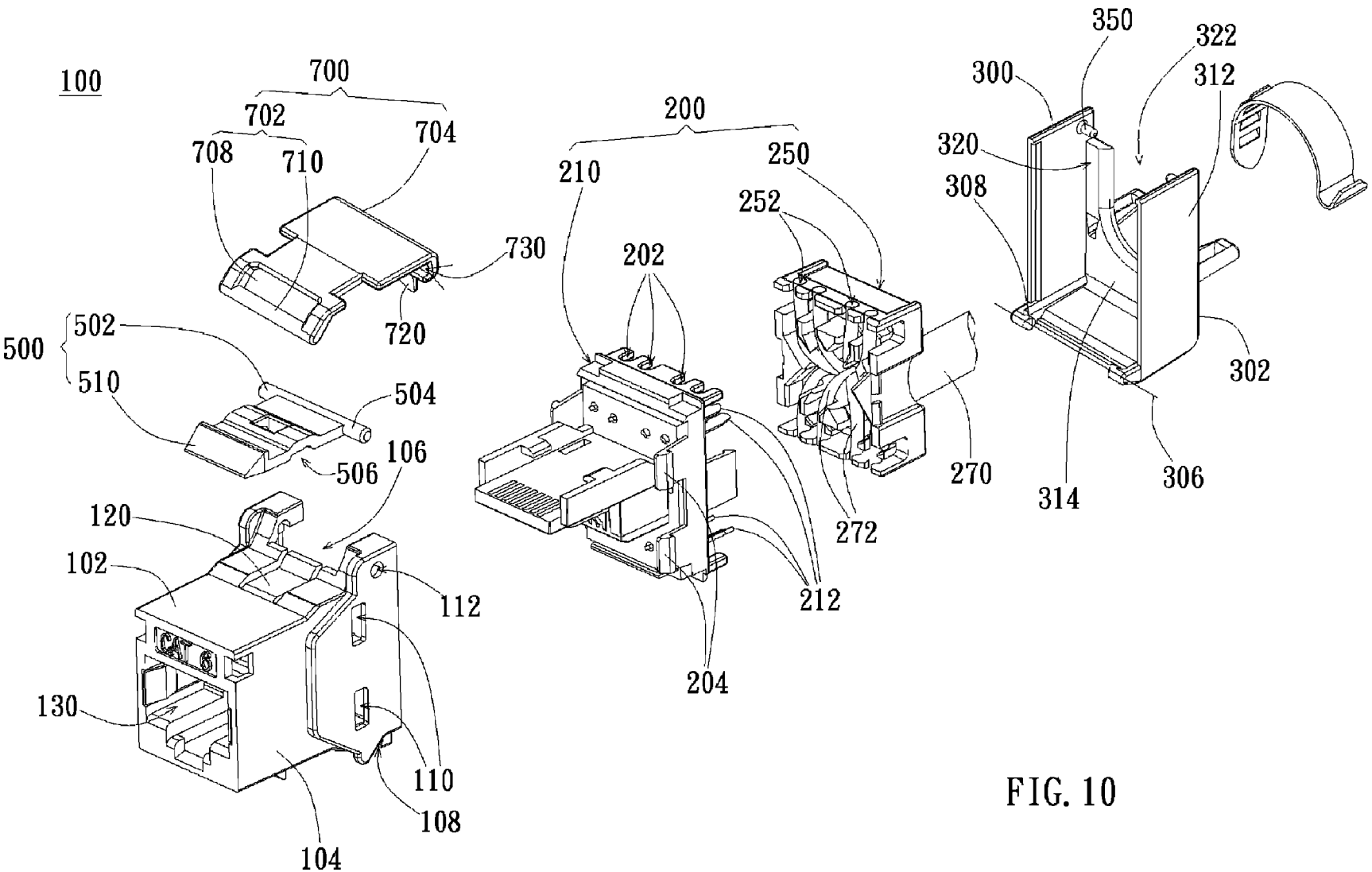
FIG. 10 is an exploded view of another embodiment of the connector of the present invention.
Figure 11:
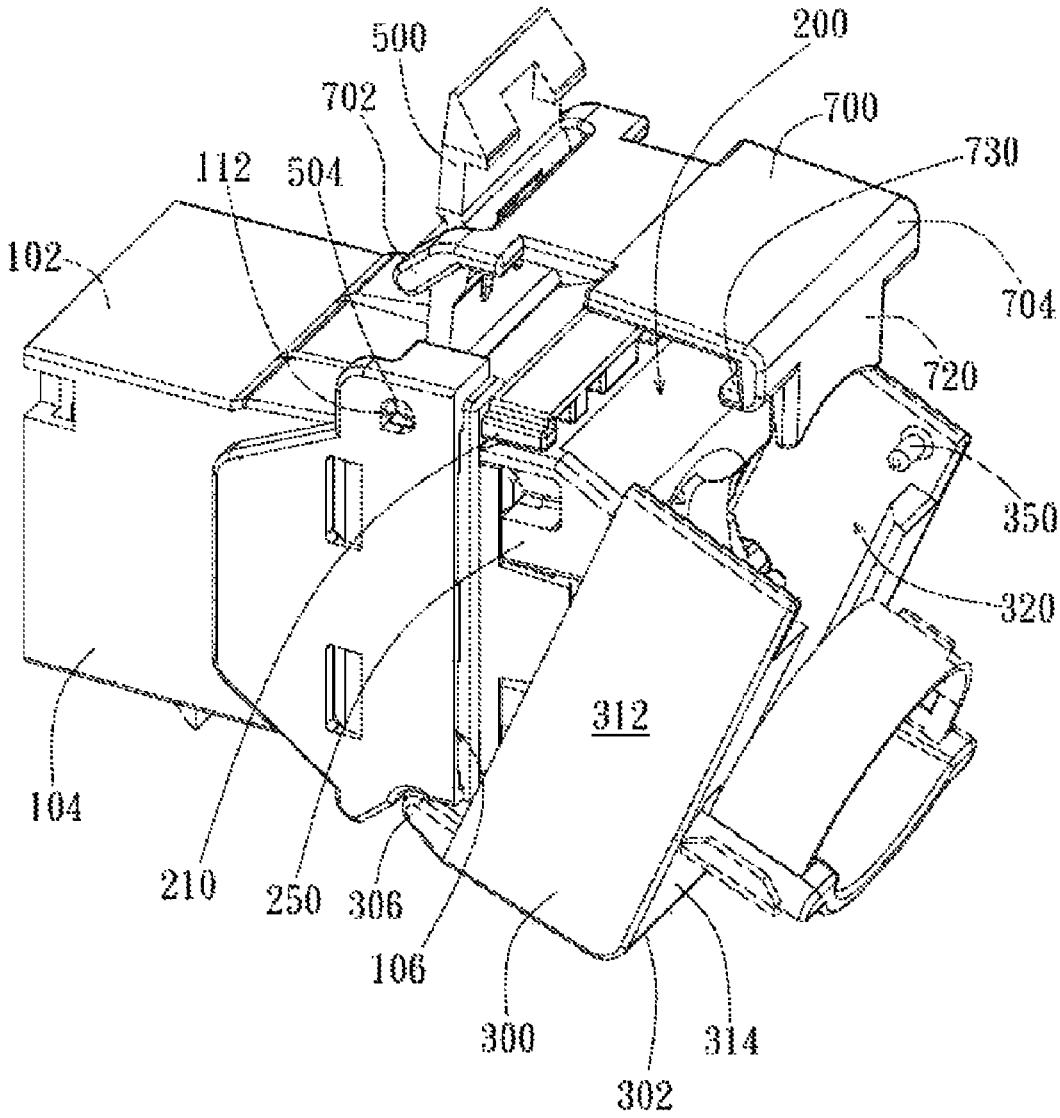
FIG. 11 is a schematic view of FIG. 10 showing the cover pressing the wire-carrying cover.
Figure 12:
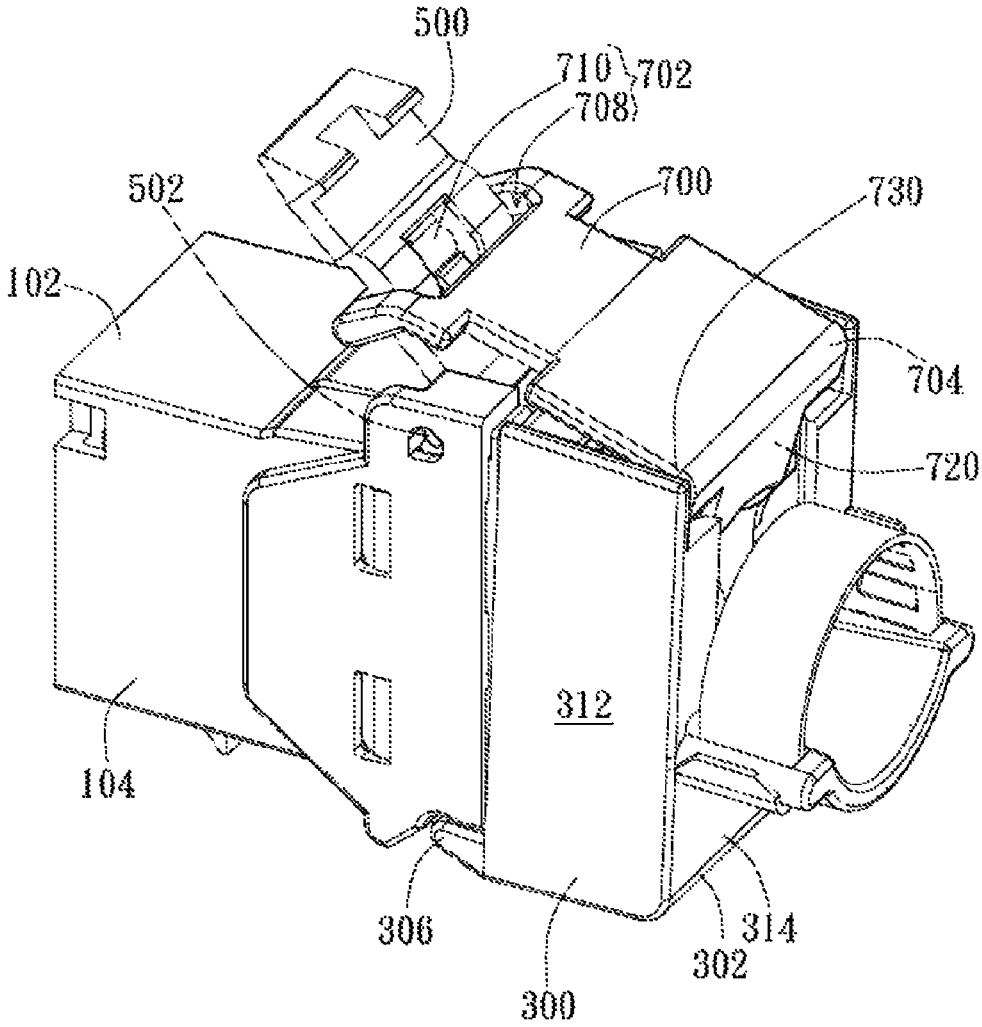
FIG. 12 is a schematic view of FIG. 10 showing the fastening plate driving the extension plate to press the wire-carrying cover.

Another embodiment of the present invention is shown in FIG. 10 to FIG. 12. The difference between the embodiment of FIG. 10 and the embodiment of FIG. 3 is the pressing mechanism of the extension plate and the cover; the structures and connections of other elements, such as the connecting body 102, the fastening plate 500, and the signal transmission unit 200 are similar to the embodiment of FIG. 3 and not elaborated hereinafter. As shown in FIG. 10, the pressing portion 704 of the extension plate 700 is preferably a pressing plate with a recess 730 on each side. Correspondingly, the cover 300 includes a pair of rods 350 axially facing each other formed on the inner faces of two opposite side cases 312. That is, the recesses 730 of the pressing portion 704 of the extension plate 700 respectively correspond to the pillars 350 and engage with the pair of pillars 350. As shown in FIG. 11 and FIG. 12, in response to the movement of the fastening plate 500 from the initial engaging position to the final engaging position, the extension plate 700 moves to allow the recesses 730 of the pressing plate to accommodate the rods 350 of cover 300 and drive the cover 300 to move toward the connector body 102. As such, the wire-carrying cover 250 is pushed by the cover 300 and appropriately assembled with the connecting base 210 so that the puncturing terminals 212 can pierce through the insulation film of the core wires 272 and connect the conductors of the core wires 272.

It is noted that the connector 100 can be optionally a metal housing. In other words, the sidewall 104 of the connector body 102, the cover 300, the fastening plate 500, and the extension plate 700 can be made of metal. After the assembly of the wire-carrying cover 250 and the connecting base 210 is completed, a shielding connector capable of preventing EMI can be formed. However, in other embodiments, the connector 100 can be made of other materials such as plastics or fiber reinforced plastics, or other electrically conductive or magnetically conductive materials, as appropriate. Besides, the signal transmitting unit 200 is preferably made of plastics or other nonconductive materials.

Figure 13:
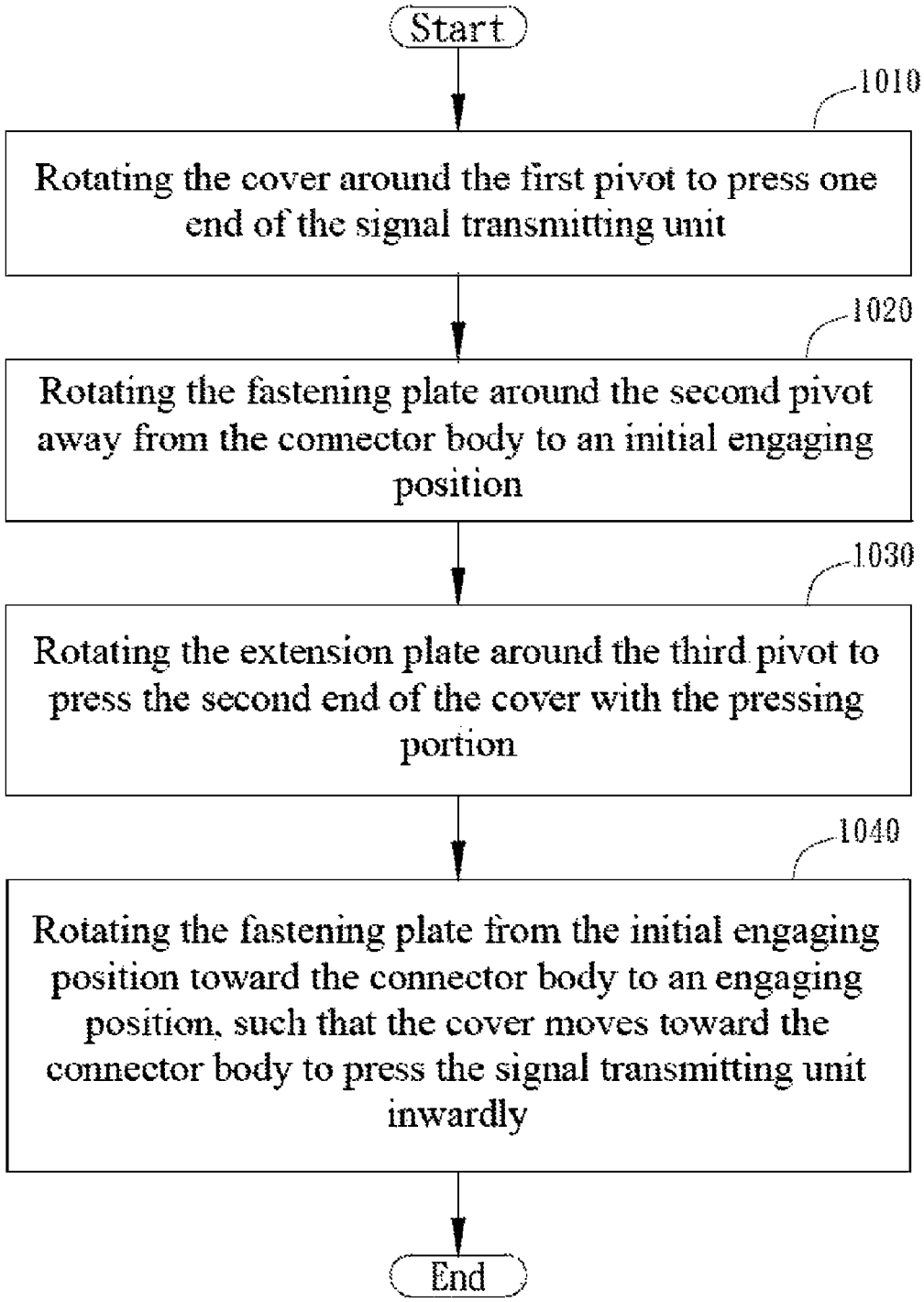
FIG. 13 is a flow chart of an embodiment of operating the connector of the present invention.

As shown in FIG. 13, the present invention further provides a method for operating the connector 100 of the above-mentioned embodiment, and the method includes the following steps. Step 1010 includes rotating the cover around the first pivot to press one end of the signal transmitting unit. Step 1020 includes rotating the fastening plate around the second pivot away from the connector body to an initial engaging position. Step 1030 includes rotating the extension plate around the third pivot to press the second end of the cover with the pressing portion. Step 1040 includes rotating the fastening plate from the initial engaging position toward the connector body to an engaging position, such that the cover moves toward the connector body to press the signal transmitting unit inwardly.

In the above-mentioned steps, the method further includes adjusting a distance between the fastening plate and the second pivot and a distance between the third pivot and the pressing portion of the extension plate to change an angle of the initial engaging position and a pressing force. In other words, when the relative length of the fastening plate and the extension plate is increased, the angle of the initial engaging position and the pressing force can be decreased correspondingly. The angle between the initial engaging position and the engaging position is between 0 degree and 155 degrees, and an angle between 0 degree and 90 degrees is preferred. However, in other embodiments, an angle between 0 degree and 60 degrees is much more preferred. In addition, in step 1010, the step of pressing the signal transmitting unit further includes assembling a connecting base with the assembly hole of the connector body, and electrically connecting a wire-carrying cover with the connecting base. In step 1040, the method further includes pressing the top end of the wire-carrying cover by a pressing board extending away from the pressing portion to enhance the engagement of the wire-carrying cover and the connecting base.

Although the present invention has been described through the above-mentioned related embodiments, the above-mentioned embodiments are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. A connector, comprising:

a connector body having side walls to enclose an assembly hole;

a signal transmitting unit disposed in the assembly hole;

a cover, disposed outside the assembly hole, having a first end, a second end opposite to the first end, and a first pivot, the first end and the first pivot disposed on two ends of a side case of the cover, the first pivot axially connected to the connector body on one side of the assembly hole;

a fastening plate having a second pivot opposite and parallel to the first pivot, the second pivot axially connected to the side wall around the assembly hole; and an extension plate, one end of the extension plate having a third pivot parallel to the first pivot and rotatably connecting to the fastening plate, the other end of the extension plate having a pressing portion to press the second end of the cover from outside to make the cover rotate toward the connector body and press the signal transmitting unit.

2. The connector of claim 1, wherein the connector body includes a pair of positioning holes, the first pivot of the cover includes a pair of pillars to be assembled with the pair of positioning holes.

3. The connector of claim 1, wherein the second end of the cover is formed with a pair of recesses, the pressing portion of the extension plate includes a pair of pillars, the pair of pillars protrude from two sides of the extension plate to be engaged with the pair of the recesses.

4. The connector of claim 1, wherein a pair of pillars extends from two sides of the fastening plate, the connector body includes a pair of cavities for being assembled with the pair of pillars to form the second pivot.

5. The connector of claim 1, wherein the fastening plate further includes a positioning groove, the extension plate includes an opening and a bar close to the opening, the fastening plate is inserted through the opening to allow the bar to be positioned in the positioning groove to form the third pivot.

6. The connector of claim 1, wherein the signal transmitting unit includes a connecting base and a wire-carrying cover, the cover presses the wire-carrying cover to move toward the connecting base.

7. The connector of claim 1, wherein the side wall of the connector body includes a resilient portion disposed corresponding to the position of the fastening plate when engaged, the fastening plate presses the resilient portion to move toward the connector body.

8. The connector of claim 7, wherein the resilient portion includes a splint cut from the side wall.

9. The connector of claim 1, wherein the cover includes a plurality of side cases, a top plate, the side cases and the top plate together form a recess.

10. The connector of claim 9, wherein a pressing board extends from the pressing portion of the extending plate, the pressing board passes through the recess and presses a top end of the signal transmitting unit when the pressing portion presses the cover.

11. The connector of claim 1, wherein the cover includes a rod, the pressing portion of the extension plate includes a pressing plate with a recess for accommodating the rod.

* * * * *